United States Patent [19]

Achikita et al.

[11] Patent Number: 5,002,728

[45] Date of Patent: Mar. 26, 1991

[54] METHOD OF MANUFACTURING SOFT MAGNETIC FE-SI ALLOY SINTERED PRODUCT

[75] Inventors: Masakazu Achikita, Kashiwa; Shinichi Sogame, Yamato, both of Japan

[73] Assignee: Sumitomo Metal Mining Company, Ltd., Japan

[21] Appl. No.: 451,947

[22] Filed: Dec. 18, 1989

[30] Foreign Application Priority Data

Dec. 19, 1988 [JP] Japan ..... 58-319951

[51] Int. Cl.[5] ..... B22F 1/00

[52] U.S. Cl. ..... 419/23; 419/29; 419/36; 419/37; 419/54; 419/58

[58] Field of Search ..... 419/23, 29, 36, 37, 419/54, 58

[56] References Cited

U.S. PATENT DOCUMENTS 4,508,567 4/1985 Mizuno et al. ..... 419/65

4,603,062 7/1986 Ecer ..... 419/65

*Primary Examiner*—Stephen J. Lechert, Jr.

*Attorney, Agent, or Firm*--Watson, Cole, Grindle & Watson

[57] ABSTRACT

A method of manufacturing a soft magnetic Fe-Si alloy sintered product comprising a step of injection molding a composition comprising an Fe-Si powder mixture blended so as to contain from 1 to 10% by weight of Si and the substantial balance of Fe and a binder a step of applying binder-removal under heating to the resultant green body and applying a degassing and Si-diffusing; and a step of subsequently applying sintering. The sintered product is, preferably, applied with further heating for obtaining better soft magnetic property. Soft magnetic property of the sintered products is as comparable with or superior to products by conventional powder metallurgy.

15 Claims, No Drawings

METHOD OF MANUFACTURING SOFT MAGNETIC FE-SI ALLOY SINTERED PRODUCT

BACKGROUND OF THE INVENTION

1. Field of the Invention

The present invention concerns a method of manufacturing soft magnetic Fe-Si alloy sintered products capable of obtaining products of excellent soft magnetic property and dimensional accuracy upon sintering.

2. Description of the Prior Art

Fe-Si series alloys have been used widely as magnetic materials, for example, as Fe-3% Si alloys have been often used for head yoke materials of dot printers.

Generally, addition of Si to Fe can increase magnetic permeability and electric resistance and improve AC magnetic property. However, as Si addition amount is increased, since the material becomes hard and fragile, it is difficult to apply plastic fabrication or grinding, to remarkably reduce the fabrication yield. Therefore, in a case of manufacturing, for example, a head yoke of a complicate shape through the steps of melting, casting and fabrication, the production cost is increased.

Then, for compensating such a drawback, products of complicate shapes have now been manufactured usually by using a precision casting process of using a die made of ceramics of a predetermined shape, casting a molten solution of an Fe-Si alloy into the die, cooling and then taking out the product from the die. However, in the precision casting method, since metal is melted and cast into a desired shape, segregation may be caused upon solidification or large pores may remain, making it difficult to stably produce products of excellent soft magnetic property.

For overcoming such a drawback, it has been attempted recently to produce Fe-Si alloy parts by means of powder metallurgy. However, since Si powder or Fe-Si alloy powder is hard, compacting is difficult in the usual powder metallurgy, even applying a great pressure upon compacting process and cracks tend to occur. In order to solve this problem, there has been proposed a method of dispersing one or both of fine Si powder or Fe-Si alloy powder with the mean particle size of less than 44 μm in a relatively coarse Fe powder such as having a mean particle size of from 40 to 100 μm, to obtain an aimed composition, thereby improving the compressibility (Japanese Patent Laid-Open Sho No. 62-27545, etc.).

However, if it is intended to maintain the dimensional accuracy when the molding product so called "green body" obtained by the improved dispersion method described above is sintered, final relative density after sintering can be increased only to about 90% at the highest and, in addition, diffusion of Si into Fe powder is insufficient making the distribution of Si not homogenous since coarse Fe powders of 44 to 100 μm is used. Since the soft magnetic property is deteriorated as the porosity is high and the Si distribution is not (more) uniform, there has been a problem that the sintered products from the green body by the method described above is remarkably poor as compared with those obtained by the melting process conducted so far.

OBJECT OF THE INVENTION

It is, accordingly, an object of the present invention to overcome the foregoing problems and provide a means capable of manufacturing high density Fe-Si alloy sintered products having excellent soft magnetic property.

SUMMARY OF THE INVENTION

The present inventors have made an earnest study for dissolving the problems and attaining the object as described above and, as a result, have accomplished the present invention based on the finding that the object can be attained by injection molding an Fe-Si powder mixture blended in a specific ratio, applying a binder removing treatment, degasing treatment, diffusing treatment, etc. and then sintering the same, as well as applying a further heat treatment at a predetermined temperature.

The first feature of the present invention resides in a method of manufacturing soft magnetic Fe-Si alloy sintered products, which comprises injection molding a composition comprising a Fe-Si powder mixture blended so as to contain from 1 to 10% by weight of Si and the substantial balance of Fe and a binder, applying a degasing treatment and a Si-diffusing treatment after or simultaneously with the a binder-removing treatment under heating and, subsequently, applying a sintering treatment.

The second feature of the present invention resides in a method of manufacturing soft magnetic Fe-Si alloy sintered products which comprises subjecting the sintered products obtained by the first feature as described above to a further heat treatment at a temperature of 800° C. to 1100° C.

The Fe-Si powder mixture used in the present invention is prepared by blending an Fe powder and an Fe-Si alloy powder or two kinds of Fe-Si alloy powders. The Fe powder preferably used herein is a powder prepared by an atomizing process and having a purity at 99–99.9% and mean particle size of 4 to 10 μm or 20 to 40 μm. The Fe-Si alloy powder preferably used herein is, for example, an Fe-Si alloy powder prepared by a gas atomizing process and having an Si content of 1.5 to 19.7% by weight and a mean particle size of 20 to 40 μm or 4 to 10 μm.

Then, the Fe-Si powder mixture is prepared so as to contain from 1 to 10% by weight of Si by using the Fe powder and the Fe-Si alloy powder described above. It is preferred to blend powders of greater particle size and finer particle size such as by blending from 50 to 80% by weight of one or both of Fe-Si alloy powder or Fe powder with a mean particle size of 20 to 50 μm and 50 to 20% by weight of the Fe-Si alloy powder with a mean particle size of 4 to 10 μm, or blending from 20 to 50% by weight of the Fe powder with a mean particle size of 4 to 10 μm and from 80 to 50% by weight of the Fe-Si alloy powder with a mean particle size of 20 to 50 μm.

As the properties required for the soft magnetic material, there can be mentioned high saturation flux density and small magnetic anisotropic constant or magnet striction constant. Further, if the material is used under an alternating current, it is necessary that electric resistance is high and iron loss is small. Si is an effective additive element for the required properties. However, no substantial addition effect is obtained if Si is less than 1% by weight, whereas the saturation flux density is remarkably reduced making it no more practical if it exceeds 10% by weight. Further, in the preparation of the Fe-Si powder mixture, if the powder with the mean particle size of 20 to 50 μm is less than 50% by weight or more than 80% by weight, packing density of the powder material in the injection molding product is reduced and the sintered density can not be improved, as well as the Si distribution in the sintered product tends to loss uniformity.

As the binder in the present invention, known binders used for injection molding powder metallurgy can be used but it is necessary to remove the binder so that the sintering furnace is not contaminated with the binder. Upon removing the binder, if residual carbon is formed and intrudes into the Fe-Si alloy, magnetic property is deteriorated and, accordingly, it is preferred to use a binder mainly composed of wax which causes less formation of residual carbon.

Such a composition comprising the Fe-Si powder mixture and the binder is prepared by mixing from 60 to 80% by volume of the Fe-Si powder mixture and 40 to 20% by volume of the binder. If the volume of the binder is less than 20% by volume, the injection molding is difficult. On the other hand, if it exceeds 40% by volume, the packing density of the starting powder in the green body is excessively low, tending to cause surface shrinkage or internal defects upon sintering.

As a method of removing the binder, there are various known methods such as heat debinding, solvent debinding, etc. depending on the kind of the binders used. Since a heat-debinding device is simple and convenient as compared with devices of other methods, heat debinding conducted in a nitrogen or hydrogen atmosphere or in vacuum at 200°–500° C. is most preferred for mass production.

The degassing treatment and the Si-diffusing treatment for the molding product is applied in a hydrogen atmosphere or in vacuum under heating to 500°–900° C. If the temperature is lower than 500° C., the Si diffusing rate is slow and degassing is insufficient. On the other hand, if it exceeds 900° C., the Fe powder transforms from α-phase to γ-phase and the diffusion rate of Si into Fe is reduced. The diffusing treatment may be conducted by heating at a predetermined temperature between 500°–900° C. for 30 to 60 min, or elevating the temperature from 500° to 900° C. for 30–60 min, which may be conducted after or simultaneously with the binder-removing treatment.

By applying these treatments, cleaness of the molding product is improved, obstacles such as oxides in the grain boundary or in the grains of the sintered product are removed and, further, Si diffusion is promoted making the Si distribution uniform in the sintered products to improve the soft magnetic property.

Then, the sintering treatment is conducted at a temperature of 1200° to 1350° C. in a hydrogen atmosphere or in vacuum for 30 to 180 minutes. The temperature is made higher than that for the conventional powder metallurgy using the compacting with the reason described below. That is, since the powder packing in the green body by injection molding is not so dense as compared with the green body by compacting, sintered density is not increased at a temperature lower than 1200° C., while crystal grain growth is promoted to produce sintered body of large crystal grains free from distortion, by which the area of the crystal grain boundary per unit volume is reduced to improve the soft magnetic property upon sintering at a temperature of not less than 1200° C. On the other hand, if the temperature is higher than 1350° C., since the liquid phase exceeds 30% of the entire volume, the deformation of the sintered product is remarkable, failing to get good dimensional accuracy of sintered products.

Although the sintered products prepared by the method according to the present invention already have excellent soft magnetic property as they are, it is effective for obtaining better property, to apply a heat treatment for the thus prepared sintered products, preferably, in a hydrogen atmosphere or in vacuum at a temperature from 800° to 1100° C. for 30 to 120 min and then gradually cool down them to 500° C. Then, more excellent magnetic property can be obtained within this temperature range.

EXAMPLE

The present invention is to be described referring to examples.

Examples 1–7

Using Fe powders and Fe-Si alloy powders each having a composition and a grain size, as shown in Table 1, Fe-Si powder mixtures were prepared each at a blending ratio also as shown in Table 1, respectively, such as Fe -1% Si (Example 1), Fe -3% Si (Examples 2–5), Fe -6.5% Si (Example 6) and Fe -10% Si (Example 7). After adding 30% by volume of a binder comprising wax and polyethylene to each of the Fe-Si powder mixtures and sufficiently kneading at 150° C., they were pelletized and then molded by using an injection molding machine into ring-like products, each of 45 mm outer diameter, 34 mm inner diameter and 2.2 mm thickness. The resultant ring-like molding products were heated in an $N_2$ atmosphere up to 450° C. at a temperature elevation rate of 20° C./Hr to remove the binder by heat decomposition. Subsequently, they were heated in a hydrogen atmosphere or in vacuum at a temperature elevation rate of 30° C./min upto 700° C. and then applied with degasing treatment and Si diffusing treatment while being kept at 700° C. for 30 min. Then, a sintering treatment was applied by heating upto 1350° C. at a temperature elevation rate of 15° C./min, maintaining at 1350° C. for 60 min, cooling down to 1000° C. and, successively, cooling by $N_2$ gas. The resultant sintering products had outer 40 mm diameter, 30 mm inner diameter and 2 mm thickness.

Magnetizing coils and search coil were wound around the resultant sintering products each by 50 turns, and a BH hysteresis curve was drawn by using a DC magnetic flux recorder to determine magnetic flux density ($B_{20}$), coercive force (Hc) and maximum permeability ($u_{max}$). Further, iron loss as the AC magnetic property was determined by an iron loss evaluation device. The results are shown in Table 1.

TABLE 1

| | Starting powder | | | | | AC magnetic property | DC magnetic property | | |
|---|---|---|---|---|---|---|---|---|---|
| Example | Kind | particle size (μm) | Blending ratio (wt %) | Composition of Fe—Si powder mixture | Relative density (%) | Iron loss (J/m³) | μmax (G/Oe) | HC (Oe) | $B_{20}$ (G) |
| 1 | Fe | 6 | 33 | Fe - 1% Si | 96 | 1,000 | 4,900 | 1.28 | 14,100 |
| | Fe - 1.5% Si | 44 | 67 | | | | | | |
| 2 | Fe | 6 | 33 | Fe - 3% Si | 98 | 1,000 | 4,250 | 1.20 | 14,500 |
| | Fe - 4.5% Si | 44 | 67 | | | | | | |

TABLE 1-continued

| Example | Starting powder Kind | particle size (μm) | Blending ratio (wt %) | Composition of Fe—Si powder mixture | Relative density (%) | AC magnetic property Iron loss (J/m³) | DC magnetic property μmax (G/Oe) | HC (Oe) | $B_{20}$ (G) |
|---|---|---|---|---|---|---|---|---|---|
| 3 | Fe | 44 | 67 | Fe - 3% Si | 98 | 1,000 | 4,100 | 1.15 | 14,200 |
| | Fe - 9% Si | 6 | 33 | | | | | | |
| 4 | Fe | 4 | 33 | Fe - 3% Si | 97 | 1,000 | 4,360 | 1.20 | 14,200 |
| | Fe - 4.5% Si | 37 | 67 | | | | | | |
| 5 | Fe | 44 | 50 | Fe - 3% Si | 98 | 990 | 4,300 | 1.20 | 14,400 |
| | Fe - 6% Si | 6 | 50 | | | | | | |
| 6 | Fe - 1.5% Si | 10 | 33 | Fe - 6.5% Si | 97 | 650 | 10,850 | 0.85 | 13,000 |
| | Fe - 9% Si | 44 | 67 | | | | | | |
| 7 | Fe - 4.5% Si | 44 | 63 | Fe - 10% Si | 96 | 750 | 1,300 | 2.30 | 9,800 |
| | Fe - 19.5% Si | 10 | 37 | | | | | | |

Note:
Iron loss (J/m³) shows a value at 5 KG of flux density and 1 KHz of frequency.

Examples 8–9

Fe -3% Si powder was prepared by blending an Fe powder of 6 μm of particle size and Fe -4.5% Si alloy powder of 44 μm particle size at a ratio of 33:67 ratio. Subsequently, a ring-like sintering products were prepared in the same procedures as in Example 1 and then they were maintained in vacuum atmosphere at 850° C. for one hour (Example 8) and at 1050° C. for one hour (Example 9), then cooled to 500° C. and, subsequently, applied with gas cooling using an $N_2$ gas. For the resultant products, various values were measured in the same procedures as those in Example 1. The flux density was determined as a value $B_5$ measured under an external magnetic field of 5 Oe. The results are shown in Table 2.

TABLE 2

| Example | Starting powder Kind | particle size (μm) | Blending ratio (wt %) | Composition of Fe—Si powder mixture | Relative density (%) | Heat treatment temperature (°C.) | AC magnetic property Iron loss (J/m³) | AC magnetic property μmax (G/Oe) | HC (Oe) | $B_5$ (G) |
|---|---|---|---|---|---|---|---|---|---|---|
| 8 | Fe | 6 | 33 | Fe - 3% Si | 98 | 850 | 1,010 | 6,240 | 0.79 | 13,280 |
| | Fe - 4.5% Si | 44 | 67 | | | | | | | |
| 9 | Fe | 6 | 33 | Fe - 3% Si | 98 | 1050 | 1,020 | 8,000 | 0.63 | 13,120 |
| | Fe - 4.5% Si | 44 | 67 | | | | | | | |

Comparative Example 1

Fe powders of 6 μm and 44 μm grain size were blended at a ratio of 33:67, from which sintering products were prepared in the same procedures as those in Example 1 and each of the properties was measured in the same procedures as in Example 1. The results are shown in Table 3.

Comparative Examples 2–4

Fe -3% Si powders were prepared by using Fe powders and Fe-Si alloy powder as shown in Table 3, from which sintered products were prepared in the same procedures as those in Example 1 and each of the properties was measured in the same procedures as in Example 1. The results are shown in Table 3.

Comparative Example 5

Fe powder of 6 μm grain size and Fe -4.5% Si alloy powder of 44 μm particle size were blended at a ratio of 33:67 to prepare an Fe -3% Si powder, from which sintering products were prepared in the same procedures as in Example 1 and, further, heat treatment was applied in the same procedures as in Example 8 at 650° C. for one hour. For the resultant products, same measurements were conducted as those in example 1. The results are shown in Table 3.

Comparative Examples 6–7

Fe -3% Si powder was prepared by using an Fe powder of 6 μm particle size and an Fe -4.5% Si alloy powder of 44 μm particle size in the same procedures as those in Example 1 except for setting the sintering temperature to 1180° C. (Comparative Example 6) and 1370° C. (Comparative Example 7) and measurements were conducted in the same way. The results are shown in Table 3.

Comparative Example 8

The same ring-products as those in Example 1 were prepared by investment casting using an Fe -3% Si alloy and each of the properties was measured in the same procedures as those in Example 1. The results are shown in Table 3.

Comparative Example 9

Fe -3% Si powder was prepared by blending an Fe powder of 6 μm particle size and an Fe -4.5% Si alloy powder of 44 μm particle size at a ratio of 33:67, which was then compacted under a pressure of 5 t/cm² to obtain products and each of the properties was measured in the same procedures as in Example 1. Results are shown in Table 3.

TABLE 3

| Comparative | Starting powder Particle size | Blending ratio | Composition of Fe—Si powder | Relative density | Heat treatment temp. |
|---|---|---|---|---|---|

TABLE 3-continued

| Examples | Kind | (μm) | (wt %) | mixture | (%) | (°C.) |
|---|---|---|---|---|---|---|
| 1 | Fe | 6 | 33 | Fe | 90 | — |
| | Fe | 44 | 67 | | | |
| 2 | Fe | 44 | 33 | Fe - 3% Si | 90 | — |
| | Fe - 4.5% Si | 44 | 67 | | | |
| 3 | Fe | 6 | 93 | Fe - 3% Si | 96 | — |
| | Fe - 44% Si | 44 | 7 | | | |
| 4 | Fe | 6 | 7 | Fe - 3% Si | 93 | — |
| | Fe | 44 | 26 | | | |
| | Fe - 4.5% Si | 44 | 67 | | | |
| 5 | Fe | 6 | 33 | Fe - 3% Si | 98 | 650 |
| | Fe - 4.5% Si | 44 | 67 | | | |
| 6 | Fe | 6 | 33 | Fe - 3% Si | 83 | — |
| | Fe - 4.5% Si | 44 | 67 | | | |
| 7 | Fe | 6 | 33 | Fe - 3% Si | 99 | — |
| | Fe - 4.5% Si | 44 | 67 | | deformed | |
| 8 | — | — | — | Fe - 3% Si | 100 | — |
| 9 | Fe | 6 | 33 | Fe - 3% Si | 90 | — |
| | Fe - 4.5% Si | 44 | 67 | | cracked | — |

| Comparative Example | AC magnetic property Iron loss ($J/m^3$) | DC magnetic property μmax (G/Oe) | HC (Oe) | $B_{20}$ (G) | Remarks |
|---|---|---|---|---|---|
| 1 | 2,500 | 2,200 | 0.82 | 10,100 | Out of the invention low density |
| 2 | 2,000 | 3,300 | 1.15 | 13,000 | Blend ratio, out of the invention low density |
| 3 | 1,950 | 3,750 | 1.25 | 13,700 | Blend ratio, out of the invention Si distribution not uniform |
| 4 | 1,970 | 3,500 | 1.10 | 13,300 | Blend ratio, out of the invention low density |
| 5 | 1,000 | 4,480 | 0.95 | (13,600) | Heat treatment temperature, out of the invention |
| 6 | 2,200 | 2,500 | 1.00 | 10,000 | Sintering temperature, out of the invention (1180° C.) |
| 7 | (—) | (—) | (—) | (—) | Sintering temperature, out of the invention (1370° C.) |
| 8 | 2,000 | 4,000 | 1.20 | 13,800 | Investment casing with no pores, low segregation |
| 9 | 2,010 | 3,800 | 1.05 | 13,000 | Sintered product by compacting process |

Note:
value in ( ) of Comparative Example 5 indicates B5 value.

From the results described above, it has been observed that the sintered products according to the present invention have high permeability, low coercive force and high flux desnity, as well as show low iron loss and have soft magnetic property as comparable with or superior to that of products prepared by the investment casting. It has also been observed that although the products obtained by compacting process also have soft magnetic property similar to that of the products of the present invention, cracks are resulted and it is difficult to obtain valuable products.

In the present invention, since a composition comprising an Fe-Si powder mixture containing Fe and Si blended within a specified range and a binder is applied with each of processing steps such as injection molding, debinding, degassing, Si diffusion, etc. followed by sintering and, further, with heat treatment, the resultant products are intact with no substantial Si segregation and no large pores, have soft magnetic property as comparable with or superior to those products obtained by the investment casting, and can improve soft magnetic property as compared with the conventional powder metallurgy. Accordingly, a remarkable effect of great industrial usefulness such as capable of stably supplying high performance soft magnetic sintered products of complicate shape can be obtained.

What is claimed is:

1. A method of manufacturing a soft magnetic Fe-Si alloy sintered product comprising:

a step of injection molding a composition comprising an Fe-Si powder mixture blended so as to contain from 1 to 10% by weight of Si and the substantial balance of Fe and a binder;

a step of applying a binder-removing treatment under heating to the resultant molding product and applying a degassing, treatment and an Si-diffusing treatment; and a step of subsequently applying a sintering treatment.

2. A method as defined in claim 1, wherein the degassing treatment and the Si-diffusing treatment are applied after the binder-removing treatment under heating.

3. A method as defined in claim 1, wherein the Fe-Si powder mixture comprises an Fe powder and an Fe-Si alloy powder or two kinds of Fe-Si alloy powders.

4. A method as defined in claim 3, wherein one of the powders has a mean particle size of 4 to 10 μm and, the other of them has a mean particle size of from 20 to 50 μm, and wherein from 20 to 50% by weight of the former and 50 to 80% by weight of the later of them are blended.

5. A method as defined in claim 1, wherein from 60 to 80% by volume of the Fe-Si powder mixture and from 40 to 20% by volume of the binder are mixed and prepared.

6. A method as defined in claim 1, wherein the binder-removing treatment, the degasing treatment and the Si-diffusing treatment are conducted at a temperature from 500° to 900° C.

7. A method as defined in claim 1, wherein the sintering treatment is applied at a temperature from 1200° to 1350° C. in a hydrogen atmosphere or in vacuum for 30 to 180 min.

8. A method of manufacturing a soft magnetic Fe-Si alloy sintered product comprising:

a step of injection molding a composition comprising a Fe-Si powder mixture blended so as to contain from 1 to 10% by weight of Si and the substantial balance of Fe and a binder;

a step of applying a binder-removing treatment under heating to the resultant molding product and applying a degasing treatment and a Si-diffusing treatment;

a step of subsequently applying a sintering treatment, and a step of applying a heat treatment at a temperature from 800° to 1100° C.

9. A method as defined in claim 8, wherein the degassing treatment and the Si-diffusing treatment are applied after the binder-removing treatment under heating.

10. A method as defined in claim 8, wherein the Fe-Si powder mixture comprises an Fe powder and an Fe-Si alloy powder or two kinds of Fe-Si alloy powders.

11. A method as defined in claim 8, wherein one of the powder has a mean particle size of 4 to 10 μm and, the other of them has a mean particle size of from 20 to 50 μm, and wherein from 20 to 50% by weight of the former and 50 to 80% by weight of the later are blended.

12. A method as defined in claim 10, wherein from 60 to 80% by volume of the Fe-Si powder mixture and from 40 to 20% by volume of the binder are mixed and prepared.

13. A method as defined in claim 10, wherein the binder-removing treatment, the degassing treatment and the Si-diffusing treatment are conducted at a temperature from 500° to 900° C.

14. A method as defined in claim 10, wherein the sintering treatment is applied at a temperature from 1200° to 1350° C. in a hydrogen atmosphere or in vacuum for 30 to 180 min.

15. A method of defined in claim 10, wherein the heat treatment is applied by maintaining the heating for 30 to 120 min under heating and, subsequently, gradually cooling down to 500° C.

* * * * *